United States Patent [19]

Sheets

[11] Patent Number: 4,958,747

[45] Date of Patent: Sep. 25, 1990

[54] BOTTLED WATER DISPENSER

[76] Inventor: Kerney T. Sheets, P.O. Box 771, Babin Rd., Duplessis, La. 70728

[21] Appl. No.: 232,842

[22] Filed: Aug. 15, 1988

[51] Int. Cl.[5] ..... B67D 5/08

[52] U.S. Cl. ..... 222/67; 222/129; 222/183; 222/146.6; 62/390

[58] Field of Search ..... 222/67, 129, 144.5, 222/205, 333, 181, 183, 185, 146.6, 146.1; 62/393, 394, 395, 390

[56] References Cited

U.S. PATENT DOCUMENTS

| | | | |
|---|---|---|---|
| 1,754,377 | 4/1930 | Tower | 222/382 X |
| 1,917,927 | 7/1933 | Denslow | 62/394 X |
| 2,912,142 | 11/1959 | Schutltz | 62/394 X |
| 3,088,289 | 5/1963 | Alex | 62/395 X |
| 3,269,143 | 8/1966 | Gasparovich | 62/394 X |
| 3,495,612 | 2/1970 | Moreland | 62/394 X |
| 4,340,050 | 7/1982 | Noiles | 604/246 |
| 4,597,509 | 7/1986 | Pereira | 222/129 |

*Primary Examiner*—Joseph J. Rolla
*Assistant Examiner*—Gregory L. Huson
*Attorney, Agent, or Firm*—Pravel, Gambrell, Hewitt, Kimball & Krieger

[57] ABSTRACT

A dispenser for housing large (for example, 5-gallon) bottled drinking water containers having a generally narrow mouth (for example, 1–2 inches in diameter) provides a cabinet having a lower end portion adapted to receive the bottle in an upright fashion so that the flat base of the bottle sits upon the lower floor portion of the cabinet and the upper open-mouth portion extends upwardly. A pump suctions water from the bottle and transmits it to a first reservoir positioned at the uppermost portion of the cabinet. The first reservoir is an ambient temperature reservoir for containing ambient temperature water such as is typically used in cooking or the like. A second cold water reservoir is contained generally below the first reservoir and receives flow therefrom via a duct which extends through the central portion of the second reservoir. The duct transmits ambient water to the second reservoir and beyond to a spigot which is affixed to the external cabinet portion of the apparatus. A second spigot transmits cold water from a second reservoir. A port through the wall of the duct allows water to replenish the cold water reservoir from the duct.

7 Claims, 3 Drawing Sheets

BOTTLED WATER DISPENSER

BACKGROUND OF THE INVENTION

1. Field of the Invention

The present invention relates to bottled water dispensers and more particularly relates to an improved bottled water dispenser for use with relatively large (for example, five (5) gallon capacity) water bottles having a flat base portion, and opposite thereto a narrow open-neck portion for filling the bottle and for dispensing fluid therefrom.

Even more particularly the present invention relates to an improved bottled water dispenser wherein the bottle is normally housed at the bottom portion of the container at ground level for easy access and movement, such as during loading of the bottle into the dispenser cabinet, and which includes an improved dust free, sanitary and energy efficient reservoir system which automatically replenishes either ambient or cold, refrigerated water to the respective reservoirs. Either cold or ambient water can be withdrawn from a pair of provided spigots. In one embodiment, a double reservoir system separately contains ambient and chilled water respectively.

2. General Background

Drinking water, such as spring water, is typically sold commercially in a plurality of different bottle sizes. A common bottled water container for spring water can be, for example, a one quart capacity, a half gallon capacity, or a gallon capacity. Theses smaller containers are usually plastic and are relatively easy to handle because the associated weight is small, such as on the order of five to ten (5–10) pounds. These smaller containers are generally cooled by placing them in a common refrigerator. A more economical way to sell bottled spring water is to put it in large containers of, for example, five (5) gallons. The five-gallon containers are used with a dispenser that holds the container and dispenses both ambient water (for cooling) and chilled water for drinking. However the five-gallon containers weigh approximately forty (40) pounds. Thus, they are difficult to transport, to lift, and to manipulate.

There are various commercially available bottled water dispensers, the most common of which is an inverted bottle-type dispenser. In using such a dispenser the five-gallon bottle must be lifted upwardly a distance of approximately three to four feet (3'–4') and then inverted, so that the open-mouth portion of the bottle faces downwardly. A water reservoir faces upwardly and as an open top to accept the bottle mouth. When the bottle is inverted, the outer surface of the bottle at the neck portion contacts the water surface of the reservoir perfecting a seal. As water is drawn from the reservoir, air enters the bottle, allowing water from the bottle to replenish the reservoir.

The problem with inverted bottle-type water dispensers is that they are virtually useless to elderly and or smaller persons. By definition, they can only be used by a family having an individual who can lift five (5) gallons (i.e., 40 pounds) upwardly a distance of three to four feet (3'–4') and then have the muscular ability to rotate the bottle three hundred sixty degrees (180°) while the open top pours water outwardly. The individual must also be able to place the open bottle onto the dispenser without substantially spilling its contents. This is virtually impossible for elderly persons, and for smaller individuals and children.

Another problem with prior bottled water dispensers is contamination. The open reservoir is unsanitary, allowing dirt, dust and lint to enter the drinking water at the open portion of the reservoir. Further, the top of the bottle touches the water adding a source of contamination. Additionally, air bubbles travel upwardly through the water during use because the inverted bottle must continually vent via the inverted open mouth. The supposedly clean drinking water literally scrubs the air of any dirt, lint, dust or the like which the air carries.

A third problem with prior bottled water dispensers is the problem of heat loss and possible compressor damage because of overuse. Because the reservoir is open and uninsulated at its top, heat transfer is substantial, causing the cooling system to overwork. Heat can also be transferred from the cooled reservoir upwardly into the bottle via the water itself as a loss of energy.

Because the bottle is at the top of the dispenser, the compressor must be located beneath the water reservoir in the dabinet of the dispenser. Heat generated by the compressor rises and accumulates around the reservoir, creating loss of energy as the water temperature entering the reservoir is heated by the air trapped in the cabinet.

There have been various attempts to solve the problem of providing a workable refrigerated water bottle dispensing system for dispensing bottled water to individuals. Various types of dispensers dispense either cold water only or a combination of cold and ambient water, and even some containers dispense cold water, hot water, or ambient water.

Various devices have been patented which relate to the dispensing of water and other fluids from canisters, bottles, or other containers. The following table provides a listing of various prior art patents which relate to various types of liquid dispensers.

LIQUID DISPENSER PATENTS

| U.S. PAT. NO. | TITLE | ISSUE DATE | INVENTOR |
|---|---|---|---|
| 1,586,745 | COOLING APPARATUS | 6/1/26 | Hulse |
| 2,063,171 | REFRIGERATING APPARATUS | 12/8/36 | Kucher |
| 2,786,338 | REFRIGERATING APPARATUS FOR COOLING LIQUIDS | 3/26/57 | Wurtz et al. |
| 2,871,675 | BEVERAGE COOLER AND DISPENSER | 2/3/59 | Cornelius |
| 4,061,184 | HEAT EXCHANGER FOR A REFRIGERATED WATER COOLER | 12/6/77 | Radcliffe |
| 4,225,059 | PORTABLE BEVERAGE COOLER AND DISPENSER | 9/30/80 | Kappos |
| 4,699,188 | HYGIENIC LIQUID DISPENSING SYSTEM | 10/13/87 | Baker et al. |
| 4,723,688 | BEVERAGE CONTAINER | 2/9/88 | Munoz |

-continued

| LIQUID DISPENSER PATENTS | | | |
|---|---|---|---|
| U.S. PAT. NO. | TITLE | ISSUE DATE | INVENTOR |
| 4,730,463 | AND DISPENSER BEVERAGE DISPENSER COOLING SYSTEM | 3/15/88 | Stanfill |

U.S. Pat. No. 4,061,184, issued to Radcliffe provides a cooling apparatus in which a heat exchanger takes the form of a cylindrical tank having an inlet at one end to receive an influent liquid to be chilled, an outlet at the opposite end of the tank from which the chilled liquid may be discharged. A cooling coil is wrapped around the outer side wall of the tank for circulating a refrigerant in conductive, heat exchange relation to the tank. A cylindrical cup-shaped baffle is arranged coaxially within the tank for directing the influent liquid toward the side wall of the tank, and a pressure-expanded, helically wound conduit is positioned between and disposed in intimate heat exchange contact with both the side wall of the tank and the cup-shaped baffle and defines two relatively separated passages through which separate portions of the influent liquid pass to be chilled by contact with the tank, the baffle and the intervening helically wound conduit.

U.S. Pat. No. 4,225,059, issued to Kappos provides an insulated ice cooled container mounted on a wheeled road traveling trailer equipped with tongue, hitch and traveling lights and attachable to a towing motor vehicle. The container is designed to hold a plurality of receptacles for beverages such as beer kegs and the like to be transported to a point of use for on-site dispensing. Dispensing hoses for the contents of the receptacles are trained through ice in an ice chamber and connect to valved spigots mounted on and exteriorly of the container. The trailer carries apparatus for pressurizing the contents of the receptacles and includes a jack leg for maintaining a level position of the container when detached from the towing vehicle. Separate latchable doors are provided for the ice chamber and the carrying area for the receptacles.

U.S. Pat. No. 4,699,188, issued to Baker et al. provides a hygienic liquid dispensing system disclosed comprised of the combination of a container for the liquid to be dispensed, the container having a neck portion terminating in an aperture for discharging the liquid therethrough; a hygienic cap extending over the aperture and at least a portion of the neck to seal the liquid in the container; and a liquid dispenser, including a sleeve adapted to receive the capped container neck and a sharpened feed tube located within said sleeve for piercing said cap. The container with its capped neck is inverted and lowered into said sleeve and is guided thereby to position the cap over the feed tube. The hygienic cap has a recessed central portion and a relatively thin bottom portion (in said recess) which is pierced by the feed tube as the container is lowered into the sleeve. This piercing allows liquid to flow from the container to the dispenser. The feed tube, cap and sleeve arrangement is such as to insure a closely interfitting seal between the cap and the feed tube prior to the piercing of the cap bottom. This seal, among others that may be formed using the novel cap and dispenser combination, assures the hygienic dispensing of liquid from the inverted container. The dispenser sleeve also serves as a means for supporting the inverted liquid container.

U.S. Pat. No. 4,723,688, issued to Munoz, provides a beverage dispenser comprised of a removable storage container incorporating an expandable bag which can be opened to the atmosphere to allow withdrawal of beverage from the container through a dispensing and cooling assembly with minimal exposure to air.

U.S. Pat. No. 4,730,463, issued to Stanfill, provides a beverage dispensing system further cools the beverage where it is dispensed at a considerable distance from the beverage storage container. The beverage conduit between the storage and dispensing sites is carried in a bundle located within an insulated jacket conduit. The bundle also contains parallel chilled liquid lines through which chilled liquid is circulated. A concentric coil is located at the dispensing site. A manifold connects the parallel beverage and chilled liquid lines to the concentric coil and to the dispensing valve.

SUMMARY OF THE PRESENT INVENTION

The present invention solves the problems and shortcomings of the prior art by providing an improved dispenser for spring water contained in relatively large bottles, such as, for example, five-gallon containers weighing as much as 40 to 50 pounds.

The present invention provides a water dispensing apparatus for use with a relatively large narrow-mouth bottles which solve the problems of lifting and manipulating the bottle which has plagued the art and those commercially available inverted type of bottle dispensers.

Further, the present invention solves the problem of contamination which has plagued the prior art and which plagues the inverted bottle water-type dispensers. The present invention does not suffer from the open reservoir arrangement of the most common commercially available bottled water dispensers thus eliminating the entry of lint, dust, dirt, and other foreign matter into the drinking water from the surrounding environment.

Further, the present invention provides a solution to the problem of contamination associated with air venting the bottle, a problem of inverted bottle-type arrangements.

The present invention solves these prior art problems and shortcomings in a simple straightforward yet workable manner by providing a water dispensing apparatus for use with large (e.g., five-gallon capacity) narrow-mouth bottles which includes a cabinet having an expanded spatial area adapted to receive a large water bottle having a narrow-mouth portion and for supporting the bottle in a preferably upright position wherein the narrow open mouth is at an uppermost position (rather than inverted) during use.

A first suction flowline is positioned to withdraw fluid from the bottle via the narrow open mouth. A sealed cap prevents entry of contaminants via the open mouth. A filter (e.g., carbon) cleans air that vents the bottle. A pump transmits fluid from the contents of the bottle in a generally upward direction via the first flowline, the pump being positioned within the cabinet and including a suction and discharge portion.

A discharge flowline communicates with the discharge side of the pump and transmits fluids from the pump.

A sealed, sanitary reservoir is spaced above the water bottle holding area of the cabinet, and receives flow from the pump via the discharge line. In one embodiment, light pressure (e.g., four (4) p.s.i.) e.g., generated by the pump pressurizes the reservoir so that water will flow therefrom via a spigot.

In one embodiment, a second "chilled water" reservoir can be positioned in close proximity to the first reservoir and can include insulation for maintaining cold water at chilled temperatures, such as well below ambient temperature. For example, water is maintained at 40° F.

In the second reservoir embodiment a flowline extends from the first reservoir through the second reservoir for transmitting fluid to the second reservoir and including a duct portion which extends through the second reservoir to a spigot discharge point for dispensing ambient temperature water.

A pair of spigots respectively dispenses ambient and cooled water and includes respective flowlines that communicate respectively with the duct (for ambient water), and with the second cold reservoir (for chilled water).

In the preferred embodiment, the cabinet is upstanding and generally rectangular in cross-section, having a generally uniform vertical cross-sectional area from its base to its top portion.

In the preferred embodiment, the first and second reservoirs are generally aligned, one atop the other.

In the preferred embodiment, the spigots can be positioned side-by-side on the external surface of the cabinet.

In the preferred embodiment, the duct includes a generally vertical section which extends downwardly from the first reservoir means, through the central portion of the second reservoir means at least in part, and there is further provided port means through the duct wall for transmitting fluid from the duct to the second reservoir means.

In the preferred embodiment, there is provided a switch for activating the pump responsive to a lowering of the water level in at least one of the two reservoir means.

In the preferred embodiment, the pump activating mechanism is a float switch which is disposed in at least the top reservoir means.

In a second embodiment, a water dispensing apparatus is provided for use with large narrow-mouth bottles. The apparatus includes a cabinet having a lower end portion with an expanded spatial area adapted to receive a large water bottle having a narrow-mouth portion and for supporting the bottle in an upright position wherein the narrow open mouth is at an upper position during use with respect to the base of the bottle.

A first flowline is positioned to withdraw fluid from the bottle via the narrow mouth opening.

A pump transmits fluid from the contents of the bottle upwardly via the first flowline, the pump including suction and discharge portions. A second discharge flowline communicates with the discharge portion of the pump and transmits fluid from the pump to a reservoir. The reservoir is maintained at a relatively small positive pressure value of, for example, four pounds per square inch (4 p.s.i.). First and second flowlines exit the pressurized reservoir. The first flowline communicates with the discharge line from the pump and is used for filling the reservoir. A valve is provided for opening flow to the reservoir from the pump discharge line when the reservoir level is depleated. The valve closes the flowline communicating with the reservoir for filling the reservoir when the reservoir level is high. A second flowline simply discharges fluid which is cooled from the reservoir. A pair of spigots communicate respectively with the discharge line from the pump and with the discharge cold water line from the reservoir. Thus, dispensing from the reservoir is achieved because of positive pressure maintained within the reservoir with respect to the cold water.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein.

DETAILED DESCRIPTION OF THE PREFERRED EMBODIMENT

Figure 1:
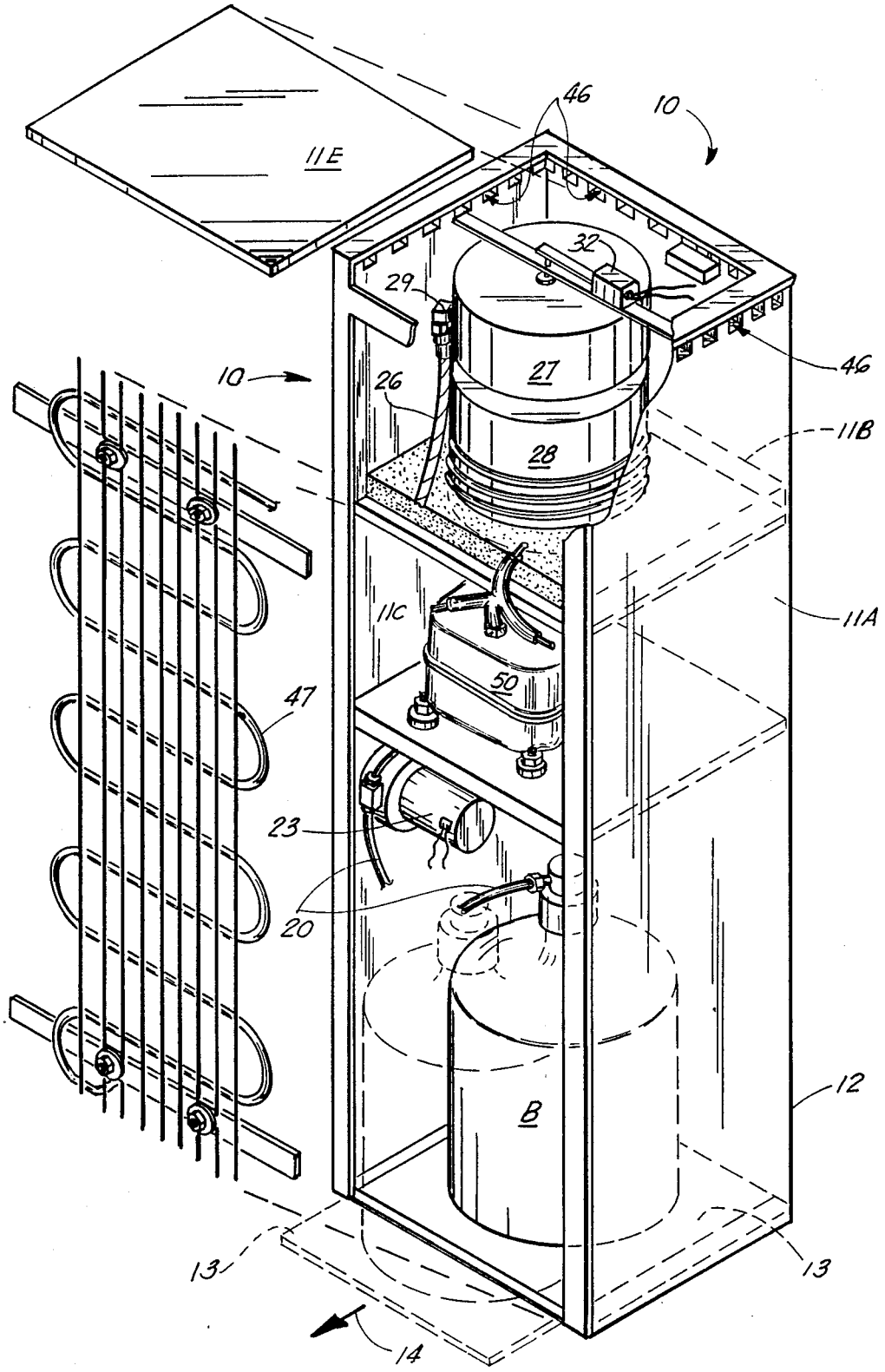
FIG. 1 is a rear perspective cutaway view of the preferred embodiment of the apparatus of the present invention.
Figure 2:
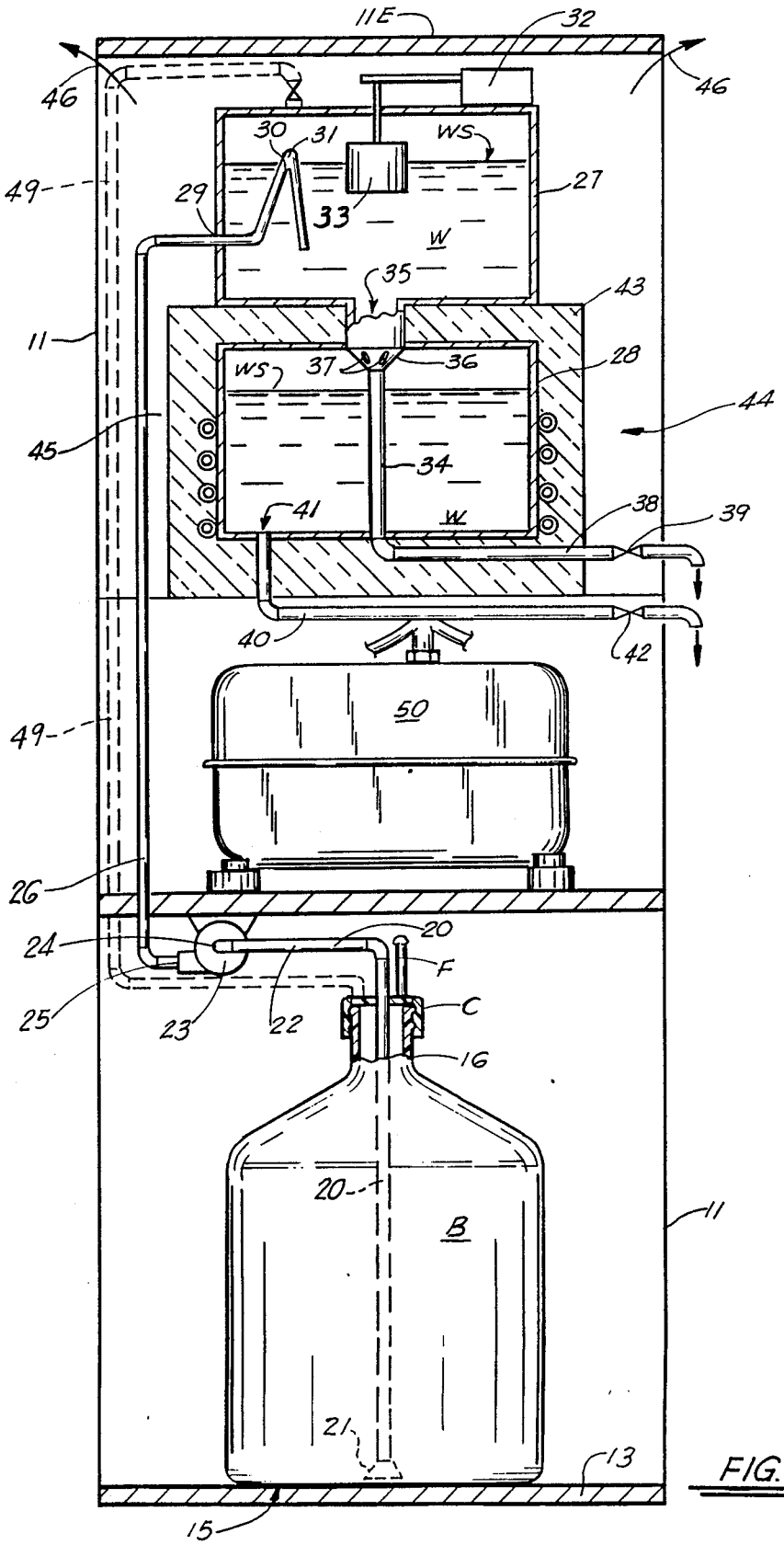
FIG. 2 is an elevational view of the preferred embodiment of the apparatus of the present invention.

FIGS. 1 and 2 illustrate the preferred embodiment of the apparatus of the present invention designated generally by the numeral 10. In FIGS. 1 and 2, there can be seen a bottled water dispensing apparatus for use with preferably large narrow-mouth bottles, such as the five-gallon capacity of bottled water containers which are common and are commercially used with refrigerated dispensers. The water dispensing apparatus of the present invention includes a cabinet 11 having a lower end portion 12 with a generally flat planar horizontal floor portion 13. The cabinet includes a plurality of walls 11A–11D, and top 11E. The front wall 11B can be, for example, be in the form of a hinged door assembly which can be single door panel or multiple door panels so that access to various portions of the cabinet 11 can be selectively opened and closed as desired.

The bottom floor 13 can be slideably mounted with respect to the cabinet 11, such as is illustrated by the Arrow 14 in FIG. 1. The floor 13 can slide either rearwardly, as shown in FIG. 1, or forwardly, or both as desired. Thus, the floor panel 13 can slide with a contained water bottle B so that the bottle B can be easily added to removed from the cabinet 11. In the preferred embodiment, the bottle B sits, as shown in FIG. 1, in a generally vertical position with the lowermost flat base portion of the bottle, designated by the numeral 15, sitting upon the surface of floor portion 13 and the uppermost neck portion 16 of the bottle B assuming a generally vertical position. The bottle neck 16 communicates with an open mouth portion 17 which allows water to be added to or dispensed from the bottle B as required. A cap C covers the open mouth 17. Thus, the cabinet 11 provides an enlarged spatial area 18 extending between the walls 11A–11B and above floor 13 upwardly to shelf 19. The spatial area 18 is adapted to receive the water bottle B therein for supporting the same in an upright position in the preferred embodiment. However, it should be understood that the bottle could, for example, be maintained in a position which is slightly tilted, or even on its side, though tilting the bottle substantially could cause leakage which would be undesirable.

A first flowline 20 is positioned, as shown in FIG. 2, to withdraw water from the bottle via the narrow open mouth 17. The flowline 20 includes a lowermost end portion 21 that communicates with the lower end portion of the bottle B and an uppermost end portion 22 that communicates with pump 23. Pump 23 is a commercially available water pump having a suction 24 and a discharge 25. Flowline 26 communicates with discharge 25 and transmits water from pump 23 upwardly in the preferred embodiment. Pump 23 can be mounted, for example, to the underside of shelf 19.

At least one reservoir receives flow of water from discharge line 26. In the preferred embodiment, a dual reservoir system is illustrated, as shown in FIGS. 1 and 2. The dual reservoir system includes a first ambient temperature reservoir 27 and a second chilled water reservoir 28. Each reservoir can be, for example, generally cylindrical in shape, and in the preferred embodiment, the reservoir 27 sits generally atop the reservoir 28. Flowline 26 extends upwardly through cabinet 11 and enters reservoir 27 at opening 29. The line 26 includes a U-tube section 30 having an vent outlet 31 which discourages siphoning of fluid from reservoir 27. In FIG. 2, the reservoir 27 includes a water supply, designated by the letter W. Water surface WS, illustrates the level of water contained within reservoir 27. The level of fluid contained within reservoir 27 can be controlled by using a commercially available float switch 32 which simply detects a rise in water surface WS or a fall in the level of water surface WS. When the water surface WS rises to a predetermined level, float 33 is lifted shutting off pump 23. Similarly, when the water surface WS level drops in reservoir 27, float 33 will also move downwardly causing the switch 32 to activate pump 23 and add fluid to replenish reservoir 27 via flowline 26.

Water added to reservoir 27 also replenishes reservoir 28. A flowline 34 extends between the lower end portion of reservoir 27 and into and through reservoir 28. Outlet 35 of reservoir 27 allows fluid to flow downwardly and enter flowline 34. A conically-shaped section of 36 of flowline 34 includes one or more ports 37 which allow fluid to exit flowline 34 and replenish reservoir 28 so that reservoir 28 is filled so long as reservoir 27 is filled.

Flowline 34 includes a section 38 which exits reservoir 28. Since the flowline 34 only travels briefly through reservoir 28, it supplies via line 38 ambient temperature water from reservoir 27 to spigot 39. A chilled water flowline 40 exits reservoir 28 at opening 41 and supplies chilled water via line 40 to spigot 42. Notice that reservoir 28 is surrounded by a layer of insullation 43 on substantially all sides thus preventing heat loss and increasing the efficiency of the apparatus. A space is provided on all sides of reservoir 28 including spacial areas 44 and 45 so that heat generated by compressor 50 can travel upwardly and around the sides of reservoir 28, exiting through vent openings 46, as shown in FIG. 2.

Compressor 50 is a commercially available compressor which cooperates with coils 47 attached to cabinet 11, in order to cool reservoir 28. Coils 47 and compressor 50 are commercially available and are similar to the types of compressors and coils used on commercially available water coolers. A plurality of coils 48 closely surround reservoir 28 for cooling it. An optional return vent line 49 connects reservoir 27 and bottle B.

Figures 3, 3A:
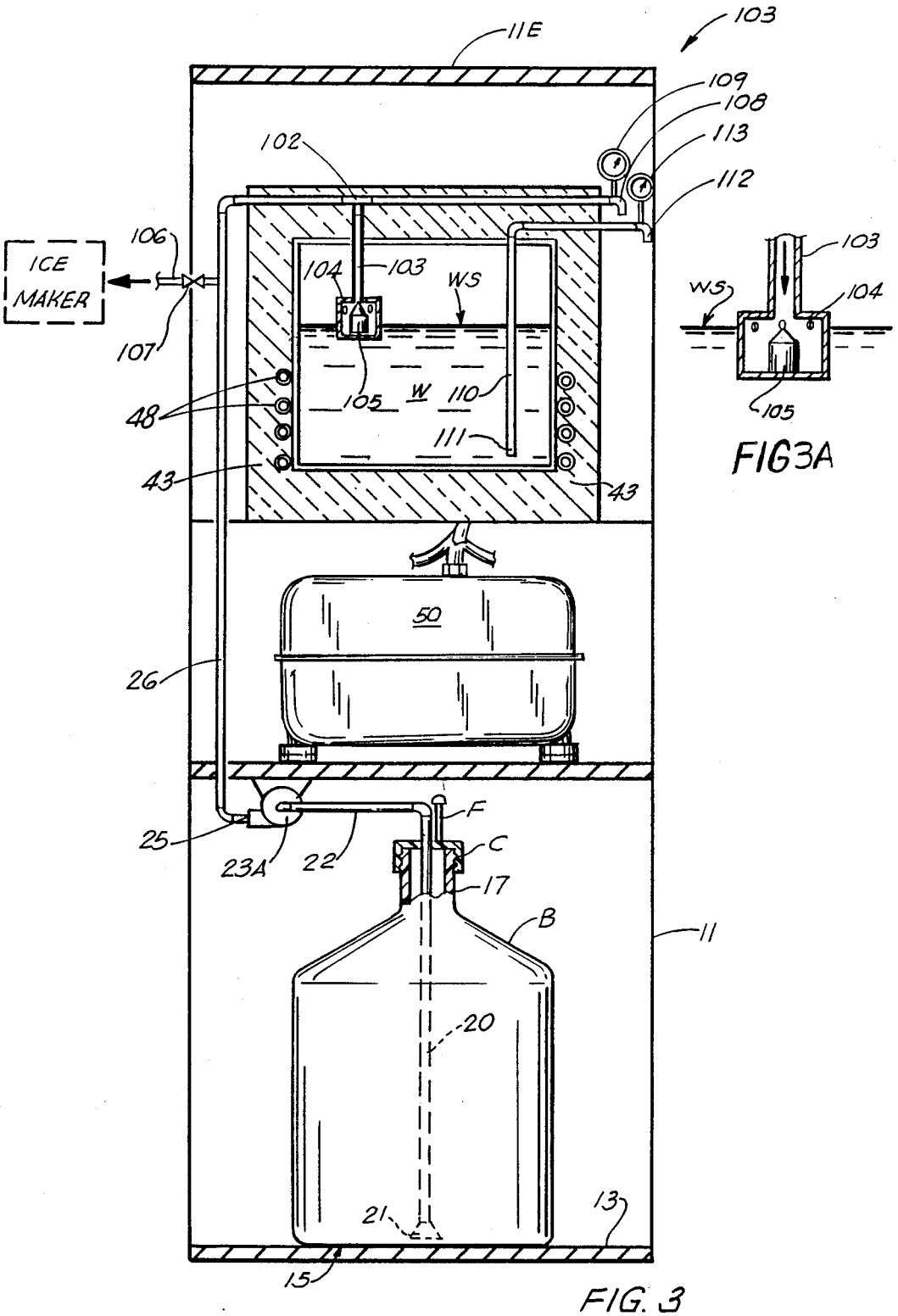
FIGS. 3–3A are elevational views of an alternate embodiment of the apparatus of the present invention.

A second embodiment using a single reservoir is desingated by the numeral 100 in FIG. 3. Dispenser 100 includes a cabinet 11 having a floor 13 for holding bottle B. A suction line 22 removes water from bottle B using pump 23A. Pump 23A preferably pressurizes reservoir 101 which, for example, is pressurized to a low pressure of about four pounds per square inch (4 p.s.i.). Pump 23A is a commercially available pump, such as a Stewart Warner brand booster pump which is a self-priming pump. Flowline 26 transmits water from the discharge 25 side of pump 23A upwardly and toward reservoir 101. A "T" 102 connection is provided at a position adjacent reservoir 101. Line 103 communicates with "T" 102 and replenishes water W to reservoir 101 when the fluid level defined by water surface WS drops. A valve 104 includes a plug member 105 which floats. When the water level is at a high level (see FIG. 3) the plug 105 seals line 103 preventing the removal of chilled water when ambient water is drawn from spigot 108. When the water surface WS drops below the level of plug 105 (see FIG. 3A) line 103 is open allowing the water in line 26 to replenish reservoir 28.

In the preferred embodiment, the pump 23A is a booster pump which activates at low pressure setting of e.g., two (2) p.s.i. and deactivates at a higher "system" pressure of e.g., four (4) p.s.i. Therefore, when water is dispensed from spigot 112, reservoir 101 is replenished through forcing float (105) down because the pump 23A pressure can overcome the buoyancy of float 105. Line 106 can be optionally supplied with a valve 107 for discharging fluid to an icemaker, for example. A spigot 108 can be used to dispense ambient temperature water from line 26 to an end user, for exampler, to be used for cooking.

Line 110 provides a discharge line for discharging chilled water from reservoir 101. Line 110 communicates with the lower portion of reservoir 101 and includes an inlet opening 111 and an outlet 112 in the form of a spigot. Because a booster pump 23A is used, line 26 can always be pressurized, preferably with a relatively low pressure of four pounds per square inch (4p.s.i.). This will ensure that the reservoir 101 will always be replenished with water via line 103.

In the embodiment of FIG. 3, the compressor 50 and coils 47, 48 used to cool reservoir 101 would similarly be commercially available cooling devices as are typically used on bottle water dispensers for cooling purposes.

In FIG. 3, a cap C can be seen sealing the open mouth 17 portion of bottle B. Filter F can be, for example, a carbon filter which allows air to enter the bottle B for purposes of preventing the development of a vacuum within the bottle B as water is withdrawn from the bottle via line 22.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A water dispensing apparatus for use with large narrow-mouth bottles comprising:

(a) a cabinet having a lower end portion with an expanded spacial area adapted to receive a large water bottle having a narrow-mouth portion and for supporting the bottle in an upright position wherein the narrow open mouth is at an upper position during use;

(b) a suction flowline positioned to withdraw fluid from the bottle via the narrow open mouth;

(c) pump means for transmitting fluid from the contents of the bottle via the suction flowline in a generally upwardly direction, the pump including suction and discharge portions, said suction portion communicating with said bottle through said suction flowline;

(d) pump discharge flowline means communicating with the discharge portion of the pump for transmitting fluid from the pump;

(e) a first, non-insulated ambient temperature water reservoir means, positioned generally vertically above the water bottle area of the cabinet and receiving flow from the pump via the discharge line;

(f) a second, refrigerated and insulated water reservoir means, positioned generally vertically above the bottle and in close proximity to the first reservoir means for maintaining the water therein cold at a refrigerated generally constant temperature, below ambient temperature;

(g) a third flowline means extending from the first reservoir to the second reservoir for transmitting ambient temperature water to the second reservoir, and including a duct portion which carries ambient water; and (h) a pair of spigots mounted on the cabinet for respectively dispensing ambient and cooled water and including flowlines that communicate respectively with the duct for ambient water and with the second cold reservoir.

2. The apparatus of claim 1 wherein the cabinet is generally rectangular having a generally uniform cross-sectional area from its base to its top portion.

3. The apparatus of claim 1 wherein the first and second reservoir means are generally vertically aligned.

4. The apparatus of claim 1 wherein the spigots are positioned side by side on the external surface of the cabinet.

5. The apparatus of claim 1 wherein the duct includes a generally vertical section which extends downwardly from the first reservoir means through the central portion of the second reservoir, and there is further provided port means through the duct wall for transmitting fluid from the duct to the second reservoir means.

6. The apparatus of claim 1 further comprising means for activating the pump responsive to a lowering of water level in at least one of the two reservoir means.

7. The apparatus in claim 1 wherein the pump activating means comprises a float switch disposed in at least one of the reservoir means.

* * * * *